US005413257A

United States Patent [19]

Amberger et al.

[11] Patent Number: 5,413,257

[45] Date of Patent: May 9, 1995

[54] LID WITH SELECTABLE TYPE OF SPOUT CLOSURE

[75] Inventors: Nancy D. Amberger, Grand Haven; John T. Dedoes, Brighton, both of Mich.

[73] Assignee: Dedoes Industries, Inc., Walled Lake, Mich.

[21] Appl. No.: 123,799

[22] Filed: Sep. 20, 1993

[51] Int. Cl.[6] ..... A47G 19/12

[52] U.S. Cl. ..... 222/472; 222/517

[58] Field of Search ..... 222/469, 470, 472–474, 222/515, 517, 556, 561, 505

[56] References Cited

U.S. PATENT DOCUMENTS

| | | | |
|---|---|---|---|
| 2,133,722 | 10/1938 | Pershall | 222/472 X |
| 2,169,239 | 8/1939 | Hacmac | 222/469 X |
| 2,251,164 | 7/1941 | Pershall | 222/469 X |
| 2,258,002 | 10/1941 | De Kay | 222/470 |
| 2,272,798 | 2/1941 | Hacmac | 222/472 X |
| 2,274,849 | 3/1942 | Peterson | 222/470 |
| 2,312,584 | 3/1943 | Peterson | 222/470 |
| 2,490,194 | 12/1949 | Barclay | 222/470 |
| 4,921,146 | 5/1990 | Salzmann | 222/472 X |
| 5,273,194 | 12/1993 | McNamara | 222/472 X |

*Primary Examiner*—Kevin P. Shaver

*Attorney, Agent, or Firm*—Gifford, Krass, Groh, Sprinkle, Patmore, Anderson & Citkowski

[57] ABSTRACT

A paint can lid is disclosed which is particularly suited for automatic stirring machines. The lid includes a body which is dimensioned to cover to open top of the can while locking feet removably secure the body to the can. A pouring spout is formed to the body for dispensing paint from the can and this pouring spout has a generally flat upper surface with an opening formed through it. The lid further includes a closure which is adapted to overlie and cover the pouring spout while an operating lever selectively moves the closure between an open and a closed position. The operating lever is selectively connected to the closure so that, upon actuation of the operating lever, the lever alternatively moves the closure between a closed position and an upwardly pivoted open position or, alternatively, a closed position and a radially inwardly retracted position.

8 Claims, 2 Drawing Sheets

LID WITH SELECTABLE TYPE OF SPOUT CLOSURE

BACKGROUND OF THE INVENTION

I. Field of the Invention

The present invention relates generally to paint can lids and, more particularly, to a paint can lid which is especially suited for use with automatic stirring equipment.

II. Description of the Prior Art

Many automotive body shops and the like use automatic paint stirring or paint mixing equipment. Such equipment includes a rack having a plurality of shelves which support a plurality of different paint cans typically filled with paint of different colors. Furthermore, the conventional lid on the paint can is replaced by a substitute lid having a stirring element, a spout and a closure which selectively opens and closes the spout. Upon insertion of the paint can into the paint can rack, mechanical means engage the stirring element so that paint in the paint can is continuously mixed or stirred while the can is positioned in the rack. In this fashion, when paint from the can is required, the paint can is removed from the rack, paint from the can dispensed and then the paint can is returned to the rack so that mixing of the paint continues.

An operating lever on the paint can lid is connected with the closure so that depression of the operating lever moves the closure from a closed to an open positioned. Furthermore, there are essentially two types of different closures that are common place in the market today.

In the first type of closure, known as the "open mouth" closure, depression of the operating lever pivots the closure so that an inner end of the closure extends obliquely upwardly from the spout. Once the operating lever is released, the closure returns to its closed position in which the closure covers the pouring spout.

In the second type of paint can lid, known as the "slider" closure depression of the operating lever radially inwardly slideably retracts the closure with respect to the pouring spout so that the outer most end of the pouring spout is opened. Paint from the can can then be dispensed in the desired fashioned. After the paint has been dispensed, release of the operating lever allows the closure to slide radially outwardly again the covering the pouring spout in the desired fashion.

In order to accommodate users of both the slider or open mouth closures, it has been the previous practice for manufacturers of paint mixing equipment to manufacture two completely different lids, one lid tier the sliding closure and one lid for the open mouth element. This necessarily and disadvantageously increases the overall tooling cost and manufacturing cost for the lids.

SUMMARY OF THE PRESENT INVENTION

The present invention provides a lid particularly suited for paint mixing equipment which overcomes all the above mentioned disadvantages of the previously known devices.

In brief, the lid of the present invention comprises a generally circular body which is dimensioned to cover the open to of the can. Means, such as locking feet, then detachably secure the body to the top of the can.

A pouring spout is formed in the body for dispensing material from the can. The pouring spout has a generally flat upper surface with an opening forming through the surface. The opening is opened to the contents, i.e. the paint, contained within the can so that the paint can be dispensed through the opening in the pouring spout.

A closure is also provided and is dimensioned to cover the pouring spout. An operating lever is selectively connected to the closure in one of two fashions. In the first fashion, the operating lever is attached to the closure so that the closure and operating lever move in unison with each other. The operating lever, in turn, is pivotally connected at one end to the lid body. Consequently, upon depression of the operating lever, the operating lever pivots the closure obliquely upwardly from the pouring spout thus forming an "open mouth" paint can lid.

Conversely, in the second fashion, the operating lever is pivotally secured to an inner end of the closure. A leaf spring is then detachably secured to the body so that one end of the leaf spring abuts against the top of the closure. Consequently, upon depression of the operating lever, the operating lever slidably retracts the closure to an opened position.

In both cases, a common spring cooperates with the operating lever to return the operating lever to its released condition.

BRIEF DESCRIPTION OF THE DRAWING

A better understanding of the present invention will be had upon reference of the following detailed description when read in conjunction with the accompany drawing, wherein like reference characters refer to like parts through out the several views, and in which.

Detail Description of the Preferred Embodiment of the Present Invention

Figure 1:
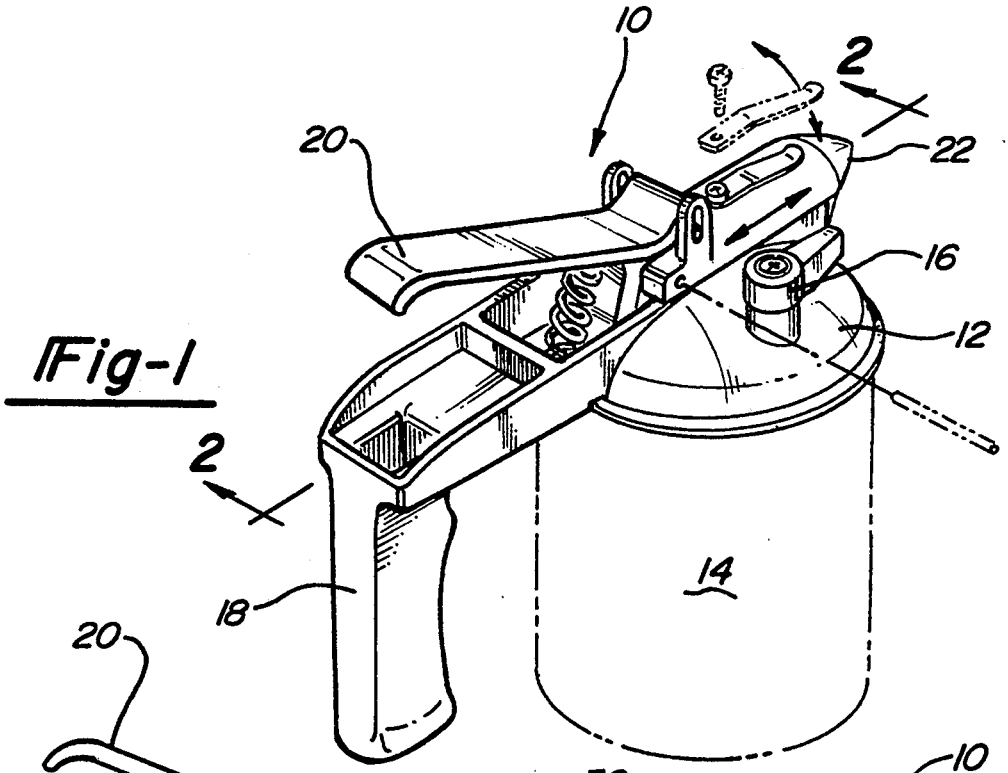
FIG. 1 is an elevational view illustrating a preferred embodiment of the present invention.

With reference first to FIG. 1, a preferred embodiment of a paint can lid 10 of the present invention is thereshown and comprises a generally circular body 12 which is dimensioned to cover the top of a conventional paint can 14. Conventional locking feet 16 detachably secure the lid 10 to the paint can 14. A handle 18 also extends outwardly from the body 12 for manipulating the lid 10 with its attached paint can 14.

Still referring to FIG. 1, an operating lever 20 is pivotally attached to the lid body 12. The operating lever 20 actuates a closure 22 in a fashion which will be subsequently described in greater detail.

Figure 2:
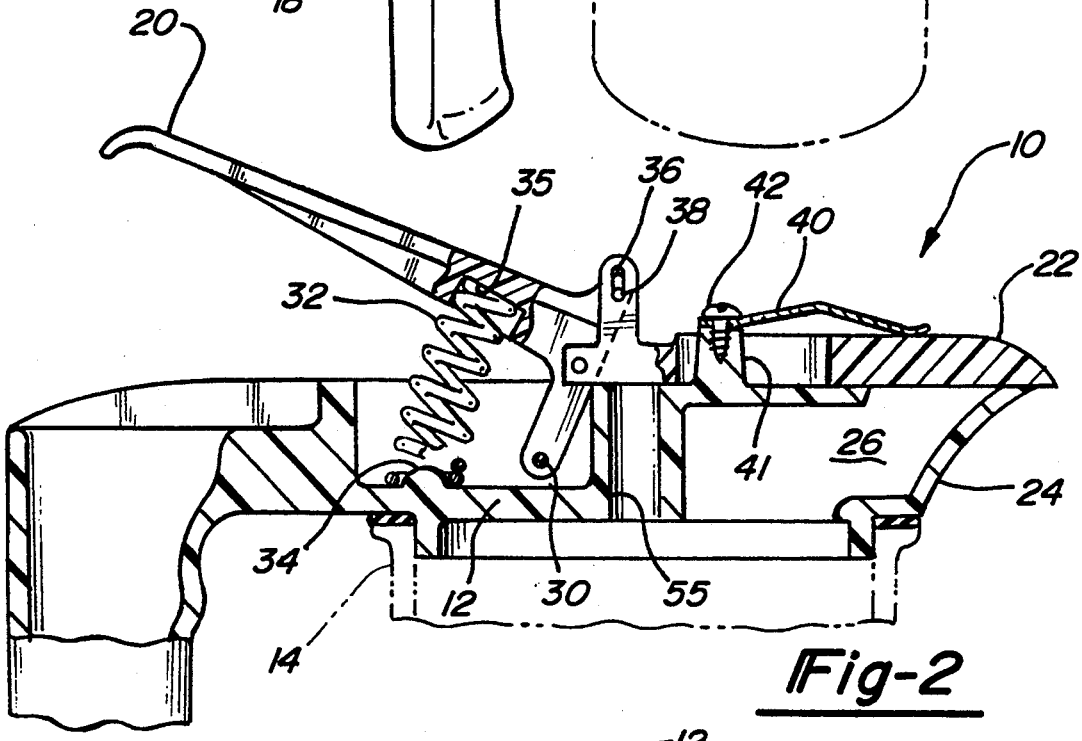
FIG. 2 is a cross sectional view taken substantially along line 2—2 in FIG. 1 and illustrating the closure in both the "slider" configuration and in a closed position.
Figure 3:
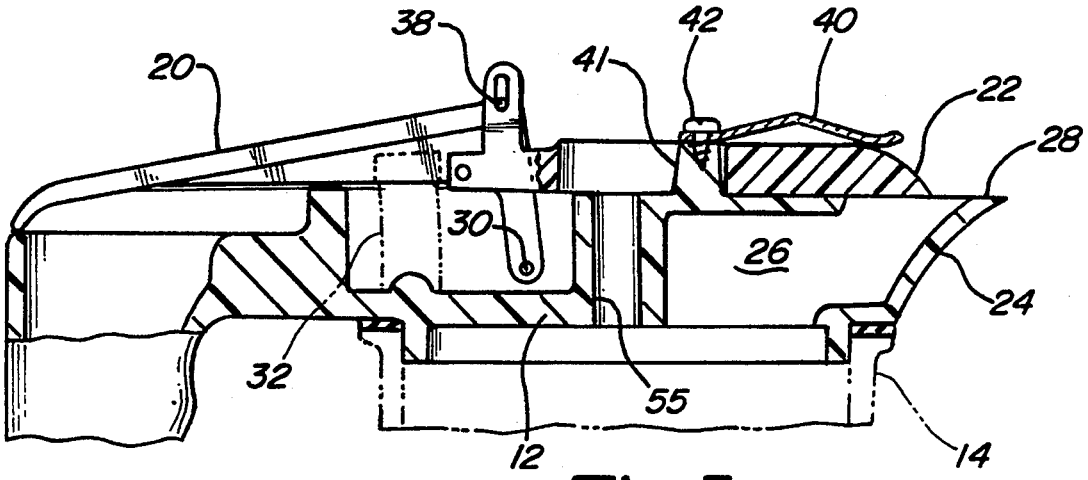
FIG. 3 is a view similar to FIG. 2, but illustrating the closure in an open position.

With reference now to FIGS. 2 and 3, a spout 24 having an opening 26 is formed to the body 12 of the paint can lid 10. This spout 24 includes a generally flat upper surface 28 through which the opening 26 extends.

Still referring to FIGS. 2 and 3, the operating lever 20 is pivotally connected to the body 12 by a pivot pin 30 so that the lever 20 is pivotal between a released position (FIG. 2) and an actuated position (FIG. 3). A helical compression spring 32 is positioned within a spring retainer recess 34 formed in the body 12. One end of the spring 32 is in abutment with the lever 20 and urges the lever 20 towards its released position.

The closure 22 is slidable along the spout surface 28 between a closed position (FIG. 2) and an open position (FIG. 3). In this open position, the closure exposes a portion of the spout opening 26 so that paint from the can 14 can be dispensed.

A vertically extending slot 36 is formed at the inner end of the closure 22. The operating level 20 (in turn) is pivotally connected to the slot 36 and the closure 22 by a pin 38. Consequently, depression of the lever 20 from its released position (FIG. 2) to its acuated position (FIG.3) causes the closure 22 to radially inwardly retract in the desired fashion.

In order to maintain the closure 22 in sliding abutment with the spout surface 28 as the closure 22 moves between its open and closed position, an elongated leaf spring 40 has one end removably secure to a boss 41 formed in the body 12 of the lid 10. The other end of the leaf spring abuts against a top surface of the closure 22 thus resiliently urging the closure 22 flatly against the spout surface 28.

Figure 5:
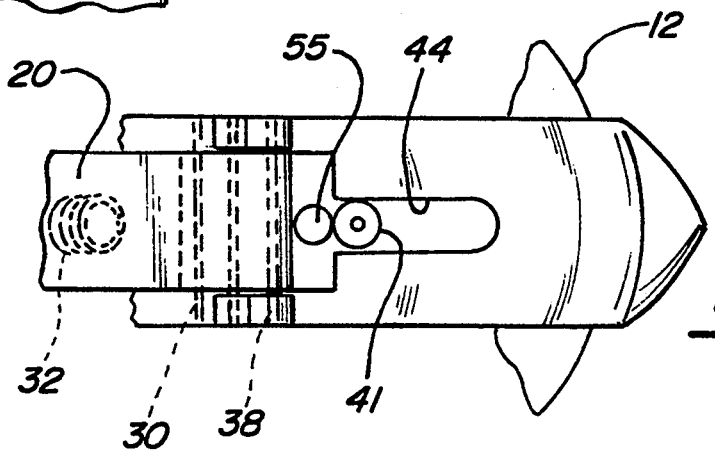
FIG. 5 is a fragmentary view taken along line 5—5 in FIG. 4.

With reference now to FIG. 5, the boss 41 registers with a slot 44 formed in the closure 22. The boss 41 thus serves to maintain the alignment of the closure 22 with the spout 24.

With the lid 10 configured in the fashion shown in FIGS. 2 and 3, the paint can lid 10 is of the "slider type" in which the closure 22 radially slides relative to the lid body 12.

Figure 4:
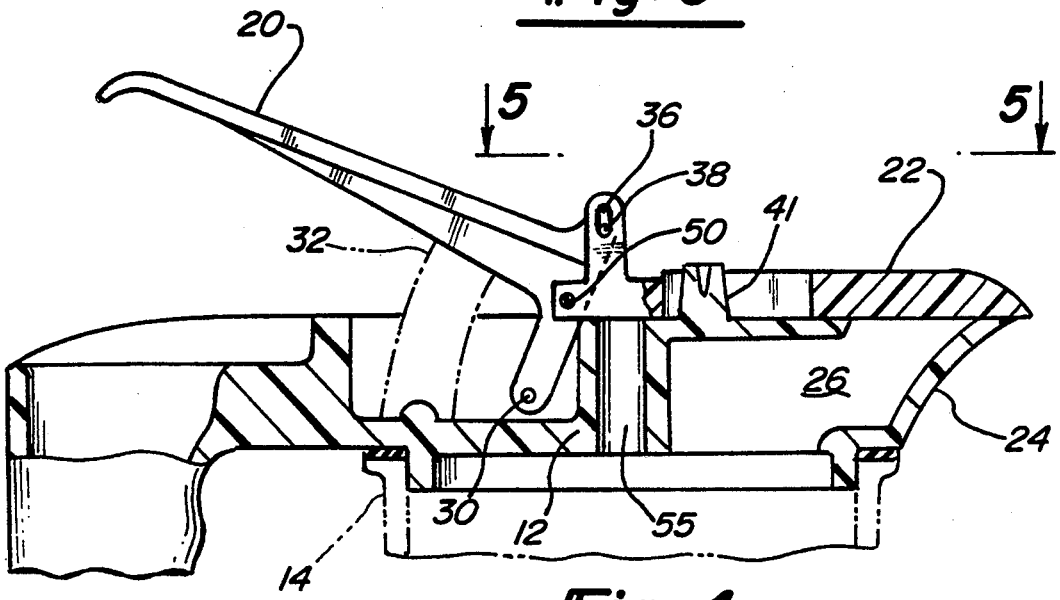
FIG. 4 is a view similar to FIG. 2, but illustrating the lid in an open mouth configuration and in a closed position.
Figure 6:
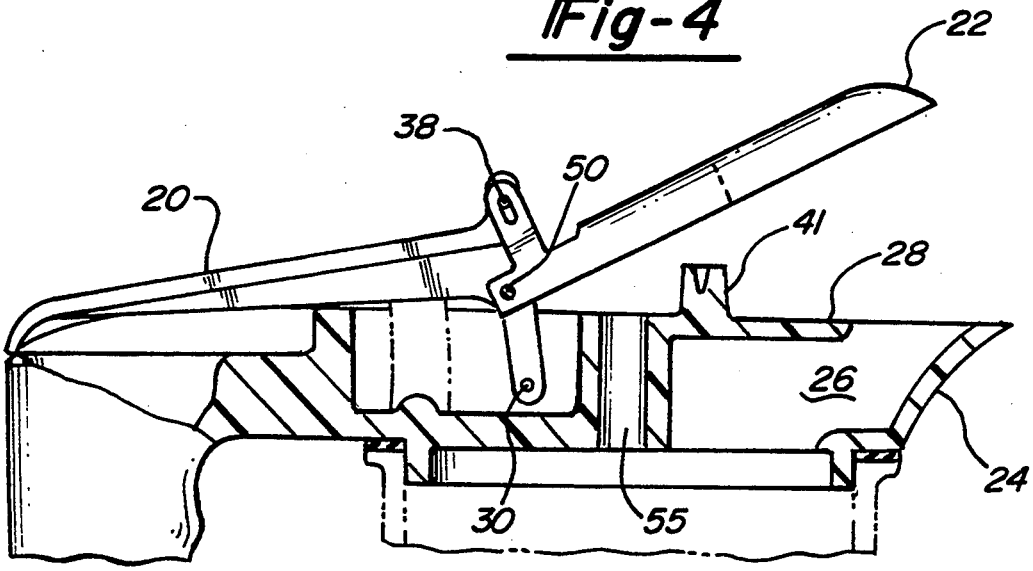
FIG. 6 is a view similar to FIG. 4, but illustrating the closure in an open position.

With reference now to FIGS. 4 and 6, however, the configuration of the paint can lid 10 in an "open mouth" configuration will now be described. In FIG. 4, the leaf spring 40 (FIG. 3) as well as its retaining screw 42 (FIG. 3) are removed from the lid body 12. Furthermore, in addition to the pin 38 and slot 36, a further pin 50 is provided through registering openings at the inner end of the closure 22 and operating lever 20. Thus, with the closure 22 and lever 20 secured together by both the pins 38 and 50, the lever 20 and closure 22 pivot in unison with each other.

Consequently, as shown in FIG. 4, with the operating lever 20 in its released position, the spring 32 urges the closure 22 against the spout 24 thus closing the spout opening 26. Upon depression of the operating lever 22 to its actuated position as shown in FIG. 6, the lever 20 pivots the closure 22 so that the closure 22 extends obliquely upwardly from an inner end of the spout surface 28 thus opening the spout opening 26 tier dispensing paint from the can. Thus, in this configuration, the paint can lid is configured as open mouth paint can lid.

The paint can lid of the present invention is designed to be used with automatic stirring equipment and, for that reason, the lid body 12 includes an opening 55 (FIG. 5) to receive the stirring element. Any conventional stirring element can be used and, since the stirring element itself forms no part of this invention, it has been omitted from the drawing.

From the foregoing, it can be seen that the present invention provides a unique convertible paint can lid in which the lid can alternatively be used as an open mouth or slider type paint can lid.

Having described my invention, however, many modifications thereto will become apparent to those skilled in the an to which it pertains without deviation from the spirit of the invention as defined by the scope of the appended claims.

I claim:

1. A lid for a can comprising:

a body dimensioned to cover an open top of the can, means for removably securing said body to the can, a pouring spout formed in said body liar dispensing material from the can, said spout having a generally flat upper surface and an opening formed through said surface, a closure, means for selectively moving said closure between a first and second position, or between a first and third position, wherein in said first position said closure covers said opening through said spout surface and closes said pouring spout, wherein in said second position said closure pivots obliquely from an inner end of the closure with respect to said upper surface of said pouring spout to thereby open said spout for dispensing material from the can, wherein in said third position said closure is retracted inwardly with respect to said body to thereby open said spout for dispensing material from the can.

2. The invention as defined in claim 1 wherein said moving means comprises an operating lever, means for pivotally mounting said lever to said body so that said lever is pivotally movable between a released position and an actuated position, means for connecting said operating lever to said closure and means for resiliently urging said lever towards said released position.

3. The invention as defined in claim 2 wherein said urging means comprises a spring.

4. The invention as defined in claim 3 wherein said body includes a recess on its top surface and wherein said spring comprises a helical compression spring position in said recess, on end of said spring being in abutment with said operating lever.

5. The invention as defined in claim 2 wherein said means for selectively moving said closure between said first position and said second position comprises means for attaching said lever to said closure so that said closure moves in unison with said lever.

6. The invention as defined in claim 2 wherein said means for selectively moving said closure between said first position and said third position comprises means for pivotally mounting one end of said lever to said closure and means for maintaining a lower surface of said closure in abutment with said spout surface while permitting said closure to slide along said spout surface.

7. The invention as defined in claim 6 wherein said means for maintaining said lower surface of said closure in abutment with said spout surface comprises an elongated leaf spring, means for detachably securing said leaf spring to said body and wherein a portion of said leaf spring is in contact with an upper surface of said closure.

8. The invention as defined in claim 1 wherein said closure is elongated and includes an elongated slot and wherein said body comprises a boss which protrodues upwardly into said closure slot.

* * * * *

UNITED STATES PATENT AND TRADEMARK OFFICE

CERTIFICATE OF CORRECTION

PATENT NO. : 5,413,257
DATED : May 9, 1995
INVENTOR(S) : Nancy D. Amberger et al It is certified that error appears in the above-indentified patent and that said Letters Patent is hereby corrected as shown below:

Column 1, lines 30-31, delete "positioned", insert --position--;

line 46, delete "fashioned", insert --fashion--;

line 48, delete "the";

line 53, delete "tier", and insert --for--;

line 65, delete "to", insert --top--.

Column 2, line 31, delete "accompany", insert --accompanying--;

line 33, delete "through out", insert --throughout--;

line 48, delete "Detail", insert --Detailed--

Column 3, line 14, delete "level", insert --lever--;

line 56, delete "tier", insert --for--;

line 57, after "as", insert --an--.

UNITED STATES PATENT AND TRADEMARK OFFICE

CERTIFICATE OF CORRECTION

PATENT NO. : 5,413,257
DATED : May 9, 1995
INVENTOR(S) : Nancy D. Amberger et al It is certified that error appears in the above-indentified patent and that said Letters Patent is hereby corrected as shown below:

Column 4, line 5, delete "an" and insert --Art--.

line 12, delete "liar" and insert --for--;

lines 42-43, delete "position", insert --positioned--;

line 43, delete "on", inert --one--.

Signed and Sealed this

Twenty-second Day of August, 1995

*Attest:*

Bruce Lehman

BRUCE LEHMAN

*Attesting Officer*

*Commissioner of Patents and Trademarks*